US008413276B2

(12) United States Patent
Rattner et al.

(10) Patent No.: US 8,413,276 B2
(45) Date of Patent: Apr. 9, 2013

(54) MATTRESS COVER WITH BED BUG BARRIER

(75) Inventors: Michael Rattner, Woodmere, NY (US); Diane Rattner, Woodmere, NY (US); Lorne Chadnick, Ottawa (CA)

(73) Assignee: Bargoose Home Textiles, Inc., Lynbrook, NY (US)

( * ) Notice: Subject to any disclaimer, the term of this patent is extended or adjusted under 35 U.S.C. 154(b) by 0 days.

(21) Appl. No.: 13/233,572

(22) Filed: Sep. 15, 2011

(65) Prior Publication Data

US 2012/0084918 A1 Apr. 12, 2012

Related U.S. Application Data

(60) Provisional application No. 61/383,043, filed on Sep. 15, 2010.

(51) Int. Cl.
*A47C 9/00* (2006.01)

(52) U.S. Cl. ..... 5/699; 5/738; 5/499

(58) Field of Classification Search ..... 5/699, 738, 5/499; 190/903; 24/389, 432
See application file for complete search history.

(56) References Cited

U.S. PATENT DOCUMENTS

| | | | | |
|---|---|---|---|---|
| 1,930,659 | A | 10/1933 | Purdy | |
| 1,991,943 | A | 2/1935 | Keviczky | |
| 2,249,841 | A | 7/1941 | Loos et al. | |
| 2,400,731 | A * | 5/1946 | Armstrong | 5/500 |
| RE24,591 | E | 1/1959 | Schwartz | |
| 3,389,441 | A | 6/1968 | Heimberger | |
| 4,164,797 | A * | 8/1979 | Golembeck | 5/738 |
| 4,397,378 | A | 8/1983 | Lee | |
| 6,223,349 | B1 | 5/2001 | Reiser | |
| 6,363,553 | B1 | 4/2002 | Baumgartel et al. | |
| 7,552,489 | B2 | 6/2009 | Bell et al. | |
| 7,849,543 | B2 * | 12/2010 | Poston et al. | 5/699 |
| 8,087,111 | B2 | 1/2012 | Paris | |
| 8,156,588 | B2 * | 4/2012 | Svoboda | 5/699 |
| 2010/0281614 | A1 * | 11/2010 | Park | 5/484 |
| 2011/0162140 | A1 * | 7/2011 | Paris | 5/499 |
| 2012/0102646 | A1 * | 5/2012 | Chen et al. | 5/499 |

FOREIGN PATENT DOCUMENTS

| | | |
|---|---|---|
| GB | 2092222 | 8/1982 |
| WO | WO 99/30594 | 6/1991 |
| WO | WO 02/082939 | 10/2002 |

* cited by examiner

*Primary Examiner* — Michael Trettel
(74) *Attorney, Agent, or Firm* — Abelman, Frayne & Schwab

(57) ABSTRACT

A mattress cover and bed bug barrier combination formed of a fabric mattress cover having walls that define an enclosure with an elongated opening extending in at least one of the walls, a zipper attached to the cover for closing the elongated opening, the cover having seal regions laterally adjacent the distal portion of the zipper, a seal element secured to each of the seal regions, an external barrier flap having a first part fixed to the cover, and a second part foldable from an open position where it is spaced apart from the seal elements to a closed position where it is folded down to overlie and seal against the seal elements, and thereby provide a barrier to travel of bed bugs inwardly or outwardly of the cover through the distal portion of the zipper when the zipper in its closed state.

8 Claims, 5 Drawing Sheets

Figures 1B, 1C, 1D:
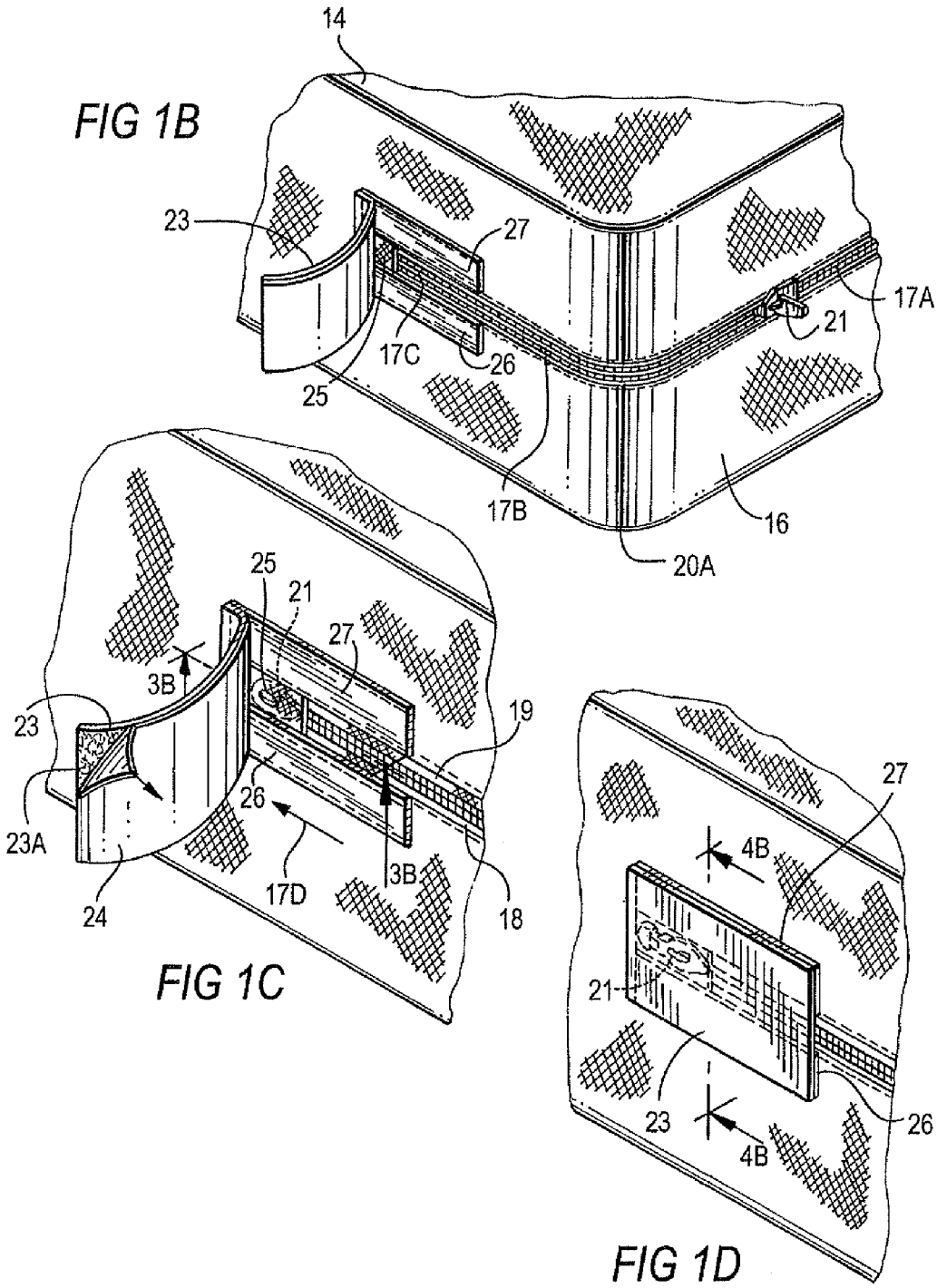

FIG 1A
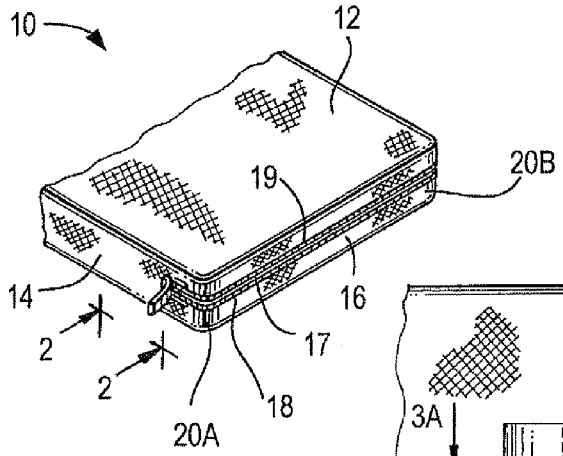
FIG 2
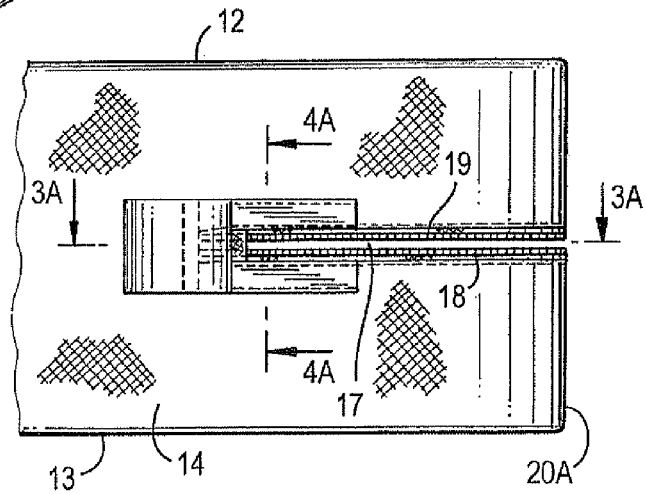
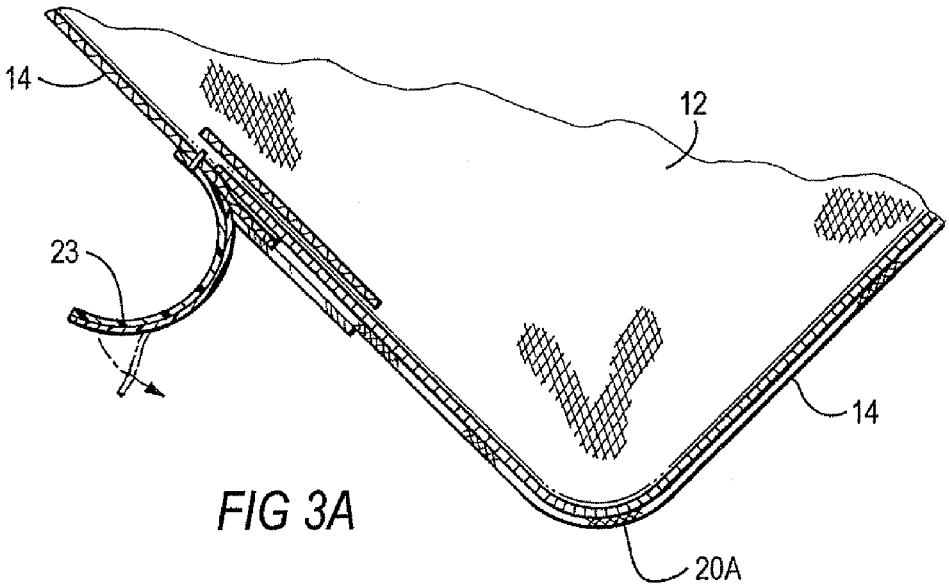
FIG 3A

MATTRESS COVER WITH BED BUG BARRIER

RELATED CASES AND PRIORITY CLAIM

This application claims priority under 35 U.S.C. §119, 120 and/or 365 on Provisional Application No. 61/383,043 filed Sep. 15, 2010.

I. FIELD OF THE INVENTION

This invention relates to mattress covers and particularly to a fabric mattress cover with an opening sufficient to receive a mattress and a zipper closure for said opening, where the fabric and the zipper of said mattress cover are intended to bar travel of bed bugs through the cover into or out of the mattress or from feeding or biting through the mattress cover. Although generally described in the context of a mattress cover, the invention is applicable to any covering or encasement intended to prevent entry of bed bugs into or escape by bed bugs therefrom through a fastened closure.

II. BACKGROUND OF THE INVENTION AND PRIOR ART

Mattress covers are generally known for basic protection of mattresses, and to provide a removable and cleanable encasement when soiled. As it became known that bed bugs may reside and multiply within mattresses, and come out and bite and feed off humans while they are sleeping or bite or feed through the cover, mattress covers have been developed which are intended to prevent egress or ingress of bed bugs through the mattress cover.

Bed bugs may reside not only in mattresses but in upholstery of furniture and are found in homes, theaters, luggage and vehicles, and have been carried in the clothing of people who have gotten them from any of many possible sources.

Mattress covers designed to protect against bed bugs are of great interest lately because of a recent epidemic in the United States, Europe and elsewhere of bed bugs not only in mattresses but in offices and even in seats in a large movie theater in New York City. The epidemic is so severe and widespread that, for example, New York State recently passed a law designated The Bed bug Disclosure Act which requires owners and lessors of residential space to notify new rental tenants of any bed bug infestations that have occurred in the building and in the specific rental unit during the past year, where a tenant is contemplating residence.

A recent article in The New York Law Journal dated Sep. 2, 2010 shows that complaints of bed bug infestations in New York were more than twenty times as high in 2009 as they were in 2004, the source of this information being the New York City Department of Housing, Preservation and Development.

There are a number of reasons for this epidemic, including (a) the massive amount of international travel where bed bugs are imported unwittingly by persons or in luggage, and (b) current statutes barring certain insecticides which previously tended to keep the bed bug population under control. There may be additional reasons regarding the sources of this massive infestation of bed bugs or explanations for how they are transported from place to place; however, the focus of the present application concerns first, efforts to contain bed bugs that are already in mattresses, mattress platforms and box springs, cushions, pillows, and covers and encasements therefore, and thus to prevent bed bugs from escaping to feed on humans sleeping or sitting on such articles, and second, to prevent bed bugs from entering such articles and encasements. As will be appreciated, the benefits of this invention may be utilized also for upholstered furniture and other products. Since fabrics resistant to bed bug penetration are known, the area of concern of this invention is escape of bed bugs or entry of bed bugs through the closure devices such as due to an incomplete zipper closure or a failure to properly position the zipper lockdown tab of a zipper closure.

The prior art includes numerous conventional mattress covers with zipper closures intending to address this problem, one particular example being prior art patent U.S. Pat. No. 7,552,489 disclosing a mattress cover with an inner bed bug barrier strip that is situated below the zipper tracks, extends a short distance in the proximal direction from the closed end of the zipper toward the open end, and is sewn to the cover along parallel paths outward of the zipper tracks to form a tunnel below the tracks, intended to block or isolate bed bugs.

In another prior art mattress cover the zipper tracks of the zipper closure section extend beyond the mattress cover encasement, and the extending zipper track portion folds back on itself with Velcro® type fastening.

III. OBJECTS AND SUMMARY OF THE NEW INVENTION

In recognizing the great potential for discomfort, inconvenience, expense and danger from bed bugs exiting mattresses while persons sleep on such mattresses or attack humans with their feeding tubes extended through a mattress cover into human skin, a principal object of the present invention is to provide a mattress cover whose zipper closure blocks bed bugs from exiting a mattress and also blocks bed bugs from entering a mattress, and thus blocks these bed bugs from biting and feeding on persons sleeping on such mattresses. It is presumed that the fabric of the mattress cover will be bed bug-proof against bed bugs biting or feeding through the fabric or passing through the fabric.

A further object is to provide a mattress cover with an external barrier flap having an adhesive surface that can be folded down to overlie the end portion of the closed zipper, and adhere tightly onto attachment strips fixed to the cover adjacent the closure ends of the zipper tracks and the zipper pull. This structure is designed to block egress of any bed bugs that have traveled past and outward of the zipper in the area of the closed zipper pull.

A still further object is to provide a more bed bug-proof mode of closure by the zipper tab at the closure end of the zipper tracks. A preferred embodiment of the present invention employs an external barrier flap having an adhesive surface that folds down onto the zipper tab in its closed position at the closure end of the zipper tracks, this flap then holding the tab in its locked down state which bars it from moving away from its closed position. The flap also serves as a visual confirmation that the tab is closed and locked down. Also the flap's adhesive surface is moldable onto the tab and the zipper tracks and into grooves adjacent said tracks to further block any possible avenues of egress of bed bugs. A still further function of the adhesive surface is to capture any bed bugs that come in contact with it. Thus, the fold-down adhesive flap can provide a plurality of different combinations of sealing functions against egress of bed bugs from within or entry of bed bugs into a mattress cover or other encasements.

Another object is to provide a mattress cover as described above, where the external barrier flap has its adhesive surface covered by a peel-off protective sheet to prevent the adhesive surface from inconveniently adhering to parts of the cover or to other things it may contact prior to the time when the zipper is closed and ready for sealing with the flap.

An additional object is to form the above-described attachment strips of a vinyl plastic with a smooth external surface to which the adhesive surface of said external barrier strip will readily, tightly and releasably adhere.

Another object is to provide a mattress cover as described above with an external barrier flap that is attached distally or downstream of the zipper closure before it is folded down to seal atop the closure ends of the zipper tracks and the zipper pull.

An additional object is to provide an external barrier flap that is attached laterally of said zipper closure area and folded down transversely across the ends of the zipper tracks and the zipper pull in its closed state.

A still additional object is to provide an external barrier strip as described in any of the objects above where adhering material is on one or both of (a) said inner surface of said external barrier flap, or (b) said outer surfaces of said attachment strips, with a protective peel-off strip removably secured onto each of said adhering surfaces.

A further object is to provide a mattress cover as described above with an internal barrier strip in addition to said external barrier flap, the internal strip fixed to said cover along one side of one zipper track and adapted to lie transversely across and beneath both tracks to serve as a further barrier or at least obstacle to egress of bed bugs from an encased mattress.

An additional object is to provide in kit form a mattress cover according to any of the above-described embodiments where the external barrier flap is initially unattached to the mattress cover, but is removably attachable to the attachment strips or to cover areas adjacent the zipper tracks. The adhesive coating on the bottom or underside of the external barrier flap, besides sealing the closure area of the zipper, can provide a flypaper-like benefit for capturing any bed bugs that reach that point of egress. Also, the flap when sealed closed provides a visual affirmation that the zipper has been closed and the external seal is in place.

Objects and advantages of the present invention will be further understood and appreciated by those skilled in the art by reference to the following written specification, claims and appended drawings.

The invention herein is further defined by the following examples.

I1. A mattress cover and bed bug barrier combination, comprising:

a. a mattress cover having flexible fabric walls that define an enclosure with an elongated opening extending in at least one of said walls, said elongated opening defined by adjacent edges of said opening, b. a zipper attached to said cover for closing said elongated opening, said zipper having a proximal end portion, a distal end portion with a distal end, and a zipper pull movable to said distal portion for closing said zipper, c. said cover having seal regions laterally adjacent said distal portion of said zipper, d. a seal element secured to each of said seal regions, each seal element having an exposed outer surface, an external barrier flap having:

i. a first part fixed to said cover, and ii. a second part foldable from an open position where it is spaced apart from said seal elements, and a closed position where it is folded down to overlie and is adapted to releasably seal against said upper surfaces of said seal elements, whereby said external barrier flap in its closed position covers said seal elements and said zipper pull between said seal elements when said zipper is closed, and constitutes a barrier to travel of bed bugs inwardly or outwardly of said cover through said distal portion of said zipper or through said cover adjacent said distal portion of said cover when said zipper is in its closed state.

2. The combination according to claim 1 where said first part of said external barrier flap is situated distally of said distal end of said zipper.

3. The combination according to claim 2 wherein said second part of said external barrier flap folds down in the proximal direction to cover said distal end portion of said zipper.

4. The combination according to claim 1 where at least one of said seal elements and said second part of said external barrier flap comprises a layer of adhesive.

5. The combination according to claim 4, further comprising a peel-off protective sheet releasably secured to each of said adhesive layers.

6. The combination according to claim 1 wherein said cover for encasing a mattress has a generally rectilinear shape with four side walls, and where said opening in said cover extends continuously along one of said side walls and along two adjacent side walls.

7. The combination according to claim 1 where each of said seal elements comprises a Velcro® (hook-and-loop) strip, and said second part of said external barrier flap has a bottom surface and a Velcro® (hook-and-loop) strip thereon that is matable with said Velcro® strips on said seal elements.

8. The combination according to claim 1 where each of said seal elements is vinyl plastic.

9. The combination according to claim 1 where said cover comprises a flexible fabric that is bed bug proof against bed bugs feeding through, traveling through or biting through said fabric.

10. The combination according to claim 1, further comprising an inner barrier sheet having opposite ends and opposite side edges and adapted to underlie said zipper, said inner barrier sheet having one of its side edges fixed to said cover along one of said edges of said opening of said cover, said inner barrier sheet adapted to be pushed up against said zipper when said cover is pulled onto a mattress which then presses against said inner barrier sheet.

11. The combination according to claim 10 where said opening has predetermined length and opposite ends, said internal barrier sheet is dimensioned to underlie said zipper along said predetermined length, and said opposite ends of said inner barrier sheet are fixed respectively to said cover at said opposite ends of said opening therein.

12. A mattress cover and bed bug barrier combination, comprising:

a. a mattress cover having walls that define an enclosure with an elongated opening extending in at least one of said walls, said elongated opening defined by adjacent edges of said opening, b. a zipper attached to said cover for closing said elongated opening, said zipper having a proximal end portion, a distal end portion with a distal end, and a zipper pull movable to said distal portion for closing said zipper, and c. an external barrier flap having:

i. a first part fixed to said cover, and ii. a second part foldable from an open position where it is spaced apart from said distal portion of said zipper, and a closed position where it is folded down to overlie and be releasably sealable to said distal portion of said zipper and to regions of said cover immediately adjacent said distal portion of said zipper, whereby said external barrier flap in its closed position constitutes a barrier to travel of bed bugs inwardly or outwardly of said cover and through said distal portion of said zipper when said zipper is in its closed state.

IV. BRIEF DESCRIPTION OF THE DRAWINGS

Figure 3C:
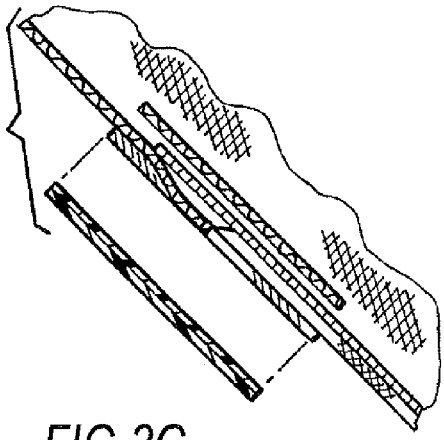
Figure 3B:
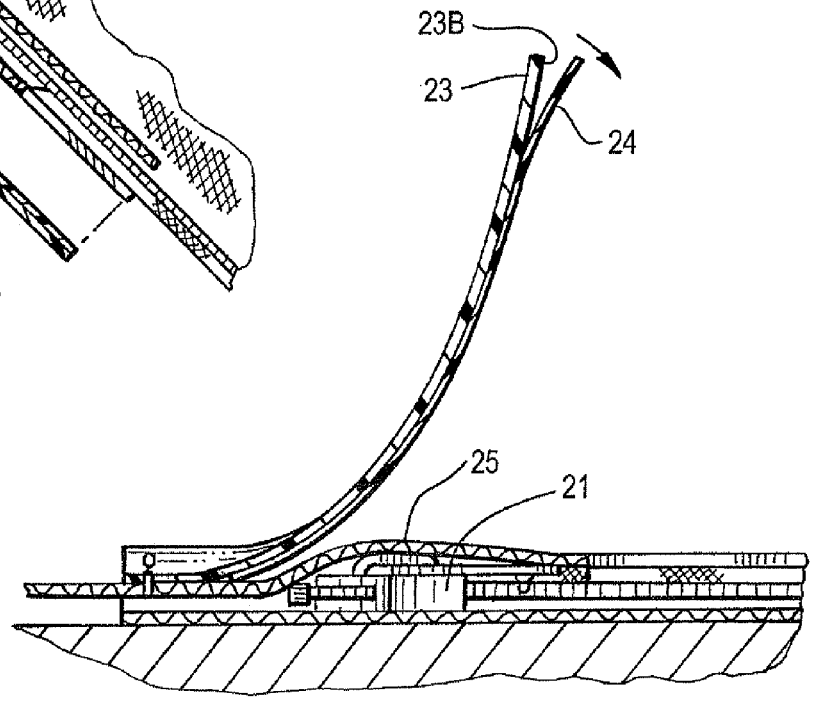
Figure 5:
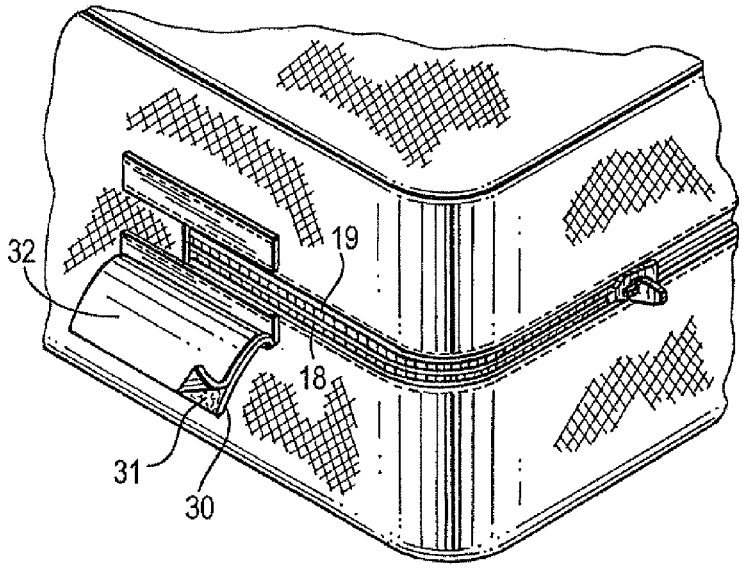
Figure 4A:
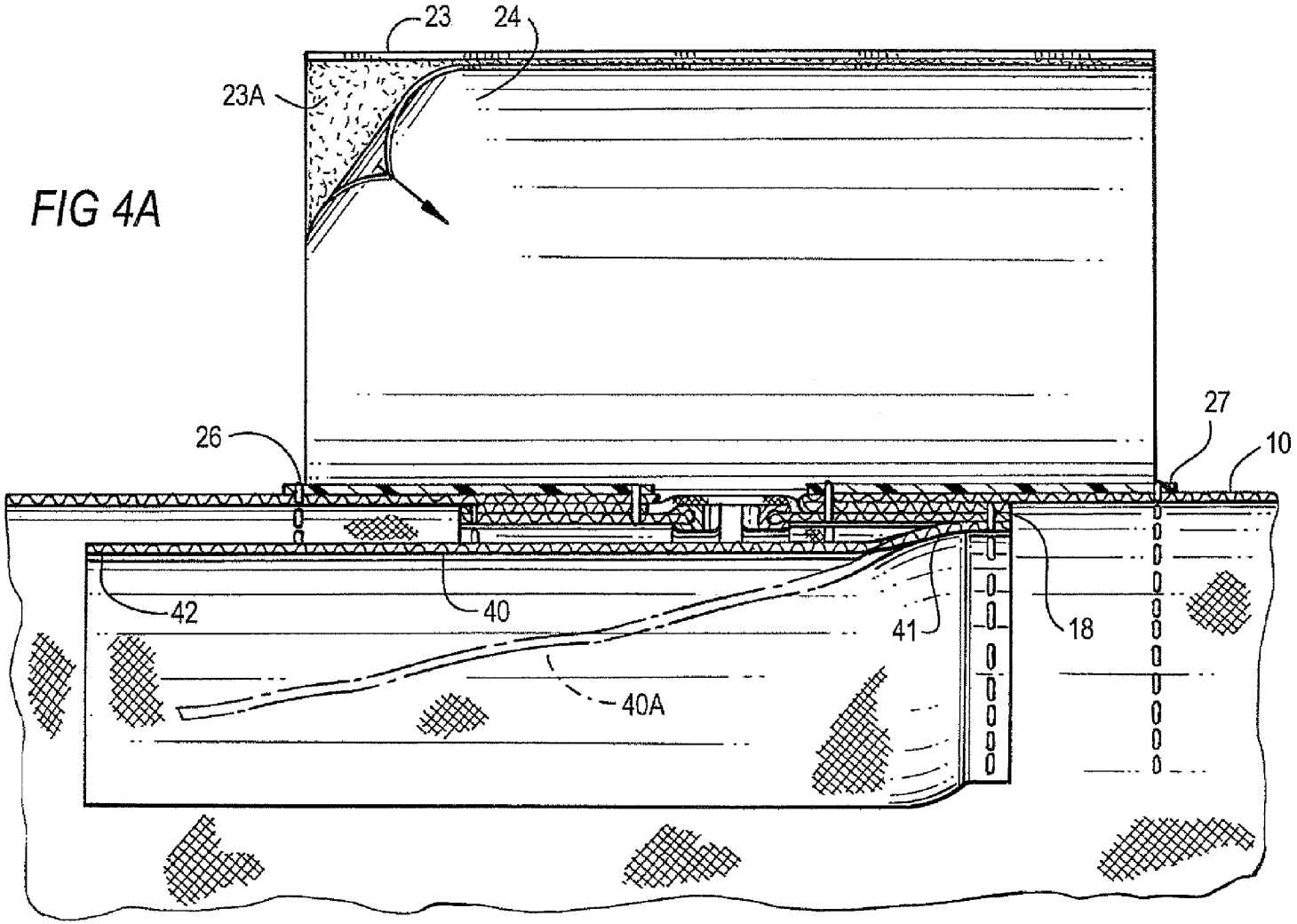
Figure 4B:
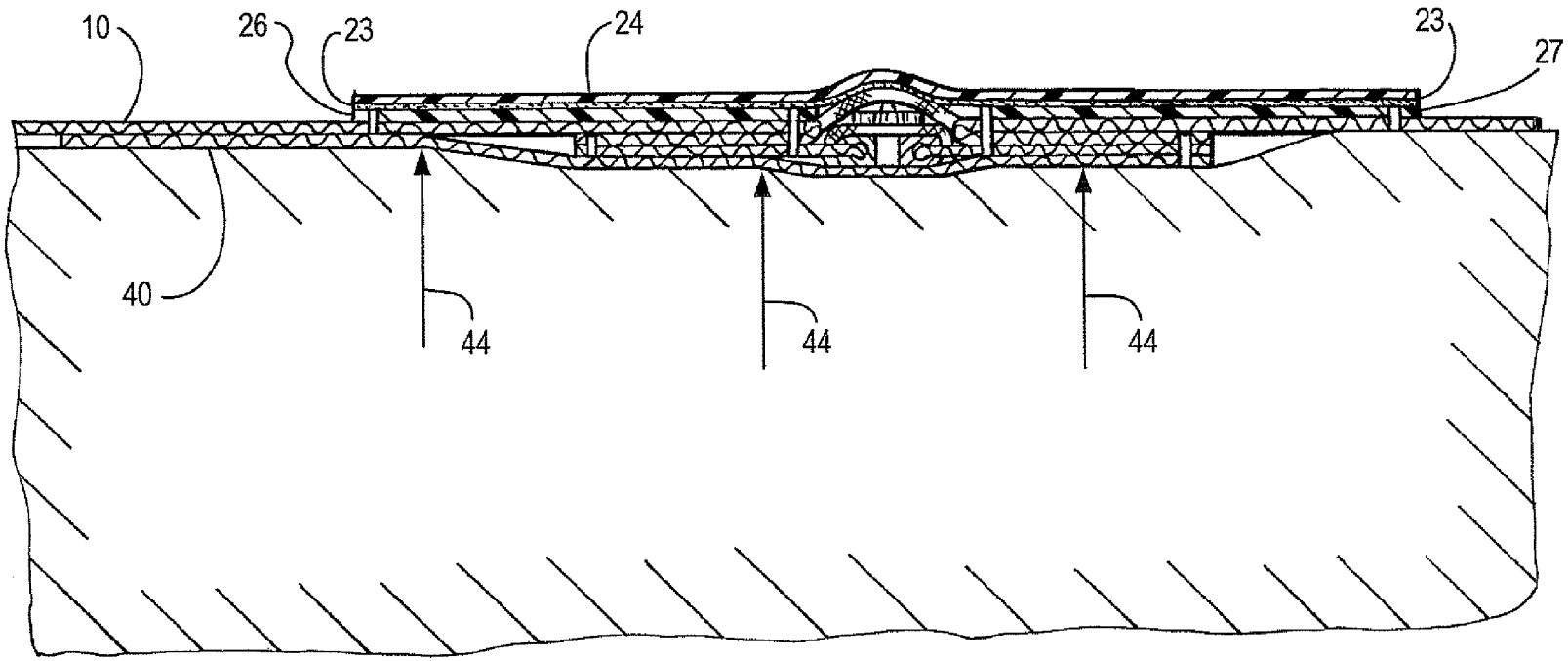

FIG. 1A is a fragmentary top end perspective view of the new mattress cover with the zipper shown in a closed state, FIG. 1B is an enlarged fragmentary top end perspective view of the new mattress cover of FIG. 1A, showing the zipper in partially closed state and attachment strips exposed, FIG. 1C is similar to FIG. 1B, showing the zipper in fully closed state, with the external barrier flap in partially folded down position, FIG. 1D is similar to FIG. 1C, with the external barrier flap fully folded down and adhered to attachment strips, FIG. 2 is a fragmentary end elevation view of the mattress cover of FIGS. A and 1C, showing the zipper in closed state and the external barrier flap in its partially folded-down position, FIG. 3A is a fragmentary sectional view taken along lines 3A-3A of FIG. 2, showing the zipper in its closed state and the external flap in its partially folded down position, as also seen in FIG. 1C, FIG. 3B is a fragmentary sectional view taken along lines 3B-3B in FIG. 1C, showing the zipper closed and the external barrier flap still partially folded-down, as also seen in FIG. 3A, FIG. 3C is a fragmentary sectional view similar to FIG. 3A, representing a second embodiment of the present invention, FIG. 4A is a fragmentary sectional elevational view taken along line 4A-4A of FIG. 2, showing said zipper closure with the external barrier flap in its partially folded-down position, FIG. 4B is similar to FIG. 4A, showing said external barrier flap sealed down onto said zipper closure, and the internal barrier strip pressed up against the underside of the zipper tracks, as it would be by an encased mattress, and FIG. 5 is a fragmentary perspective view generally similar to FIG. 1C, but representing a third embodiment of the new mattress cover.

V. DETAILED DESCRIPTION OF THE PREFERRED EMBODIMENT

For convenience and clarity in describing these embodiments, similar elements or components appearing in different figures will have the same reference numbers.

The new mattress cover 10 shown in FIG. 1 has top wall 12, bottom wall 13, side walls 14, 15 and openable end wall 16 with zipper 17 formed of zipper tracks 18, 19, extending along the length of end wall 16 and further extending partially around the corners 20A, 20B of the cover and along the side walls 14, 15 respectively.

FIGS. 1B, 1C and 1D illustrate stages of zipper closure, where FIG. 1B shows the zipper 17 closed in the area 17A and open in the area of 17B all the way to the end 17C. Thus, zipper pull 21, alternately called zipper tab, has closed area 17A of the zipper upstream in the direction of arrow 17D. At the open end 17C zipper tracks 18, 19 are slightly spaced apart. Also in FIG. 1B the external barrier flap 23 is shown in its upward partially folded-down position with its bottom adhesive coated surface 23A covered by a protective strip 24. FIGS. 1B and 1C show vinyl strips 26, 27 fixed to cover 10 adjacent the end portions of zipper tracks 26 and 27.

FIG. 1D illustrates completion of the zipper closure process of FIGS. 1B and 1C, showing zipper pull 21 moved into its final closure position, drawing together zipper tracks 18, 19, with pull 21 positioned partially or fully under transverse strip 25 which creates a tunnel for zipper pull 20.

FIG. 3B, as a fragmentary sectional view taken along line 3B-3B in FIG. 1C, shows transverse strip 25, which is either an extension of the basic cover fabric or a separate strip, lying across the closure ends tracks 26, 27, forming a tunnel construction into which zipper pull 21 is inserted on closure of the zipper.

Reviewing the zipper closure stages, FIGS. 1C, 3B and 4A show exterior barrier flap 23 in its partially folded-down position, and FIGS. 1D and 4B show external barrier flap 23 in its fully folded-down and sealed position atop vinyl strips 26, 27 and zipper tracks 18, 19. In this sealed or closed position adhesive surface 23A of flap 23 tightly adheres to the outer surfaces of vinyl strips 26, 27 and to exposed top surfaces of zipper tracks 18, 19, and to any exposed upper surface of zipper pull 21, thus sealing off any opening that might have existed in the area of the terminal end zipper closure where pull 21 is positioned adjacent the terminal ends of zipper tracks 18, 19.

FIGS. 1C and 4A further illustrate peel-off strip 24 exposing adhesive surface 23A of barrier flap 23. As indicated, strip 24 is peeled off flap 23 just before flap 23 is fully folded down to engage vinyl strips 26, 27. It would be an optional alternative to have the adhesive surface and peel-off strip on vinyl strips 26, 27 for subsequent adherence to flap 23 instead of peel-off strip and adhesive on flap 23.

In still further variations attachment strips 26, 27 are not required to be vinyl, but could be any material, surface or coating to which external barrier flap can be securely adhered.

A still further embodiment of the above-described invention is shown in FIG. 5 where external barrier flap 30 is secured to cover 10 on one side of zipper track 18, and adapted to fold transversely across and seal to both tracks 18, 19. Peel-off strip 32 exposes adhesive surface 31.

In a still further alternative structure the adhesive surface would be replaced with Velcro® or similar engageable layers on the flap and vinyl strips respectively.

Another embodiment shown in FIG. 3C this invention takes the form of a kit comprising a mattress cover encasement with a zipper closure of the opening, attachment strips secured to the cover adjacent the closure ends of the zipper tracks, an external barrier flap adapted to overlie said attachment strips, adjacent ends of the zipper tracks and the zipper pull adhering in its closed position, and adhering material on at least one of said underside of said external barrier flap and the external surfaces of said attachment strips for adherence of said flap onto said attachment strips and zipper pull.

FIGS. 4A and 4B illustrate a further feature and embodiment of the present invention, namely the above-disclosed structure with the further element of an internal barrier strip 40 which is an elongated strip extending the full or partial length of the zipper opening. Strip 40 has opposite side edges 41 and 42, with only one edge sewn to the cover 10, and accordingly the remainder of internal flap 40 can hang down freely away from the zipper closure. In FIG. 4B internal barrier strip 40 is shown horizontally as it would appear if a mattress were inside the mattress cover, and the mattress was then pushing upward as indicated by arrows 44 against the bottom of internal barrier strip 40. Otherwise, the barrier strip 40 is free to hang as seen in dashed line representation 40A in FIG. 4A. This strip 40 may be sewn at one or both of its ends which correspond to ends of the zipper tracks themselves. When employing both external barrier flap 20 and internal barrier strip 40 along with attachment strips 26, 27, all potential openings for bed bugs to exit a mattress cover are restricted, namely any path beneath and toward the zipper closure, the junction of the zipper pull with the ends of the zipper tracks, any path beyond the zipper pull.

The preferred embodiment of the new mattress cover is constructed of polyester knit fabric and urethane laminate that is impervious to penetration or passage therethrough by bed bugs; however other fabrics may be used if they are bed bug proof against bed bugs feeding through, biting through or traveling through the fabric. Conventional zippers may be used, so long as they too are bed bug proof. The attachments strips are preferably vinyl sheet material, but other materials are acceptable they are suitable for releasable attachable to the external barrier flap. The external barrier flap is preferably a conventional fabric tape with an adhesive material or coating on one side and a peel-off protection sheet on the adhesive side.

The above-described mattress cover structures provide apparatus embodiments of the present invention, which can also be defined as a method of achieving secure releasable closure against exit of bed bugs from within a mattress cover.

Such method, with a mattress cover having a zipper closed opening, comprises the steps:

a. providing generally flat attachment strips on the outer surfaces of the mating zipper tracks near their closure end, b. providing an external barrier flap with a first part thereof fixed to said cover near said zipper closure end, with a main part thereof extending from said first part and situated in its open position spaced apart from said zipper closure end, where said main part has one adhesive surface covered by a peel-off protective sheet, c. closing said zipper, after inserting a mattress within said cover, by moving the zipper pull to the closure ends of said tracks, and d. removing said peel-off protective sheet and folding said main part adhesive surface down onto said attachment strips for sealing said zipper closure.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. A mattress cover and bed bug barrier combination, comprising:

a. a mattress cover having flexible fabric walls that define an enclosure with an elongated opening extending in at least one of said walls, said elongated opening defined by adjacent edges of said opening, b. a zipper attached to said cover for closing said elongated opening, said zipper having a proximal end portion, a distal end portion with a distal end, and a zipper pull movable to said distal portion for closing said zipper, c. said cover having seal regions laterally adjacent said distal portion of said zipper, d. a seal element secured to each of said seal regions, each seal element having an exposed outer surface, an external barrier flap having:

i. a first part fixed to said cover, and ii. a second part foldable from an open position where it is spaced apart from said seal elements, and a closed position where it is folded down to overlie and is adapted to releasably seal against said upper surfaces of said seal elements, whereby said external barrier flap in its closed position covers said seal elements and said zipper pull between said seal elements when said zipper is closed, and constitutes a barrier to travel of bed bugs inwardly or outwardly of said cover through said distal portion of said zipper when said zipper is in its closed state, where at least one of said seal elements and said second part of said external barrier flap comprises a layer of adhesive, and where a peel-off protective sheet is releasably secured to each of said adhesive layers.

2. The combination according to claim 1 where said first part of said external barrier flap is situated distally of said distal end of said zipper.

3. The combination according to claim 2 wherein said second part of said external barrier flap folds down in the proximal direction to cover said distal end portion of said zipper.

4. The combination according to claim 1 wherein said cover for encasing a mattress has a generally rectilinear shape with four side walls, and where said opening in said cover extends continuously along one of said side walls and along two adjacent side walls.

5. The combination according to claim 1 where each of said seal elements is vinyl plastic.

6. The combination according to claim 1 where said cover comprises a flexible fabric that is bed bug proof against bed bugs feeding through, traveling through or biting through said fabric.

7. The combination according to claim 1, further comprising an inner barrier sheet having opposite ends and opposite side edges and adapted to underlie said zipper, said inner barrier sheet having one of its side edges fixed to said cover along one of said edges of said opening of said cover, said inner barrier sheet adapted to be pushed against said zipper when said cover is pulled onto a mattress which then presses against said inner barrier sheet.

8. The combination according to claim 7 where said opening has predetermined length and opposite ends, said internal barrier sheet is dimensioned to underlie said zipper along said predetermined length, and said opposite ends of said inner barrier sheet are fixed respectively to said cover at said opposite ends of said opening therein.

* * * * *